US006481146B2

(12) United States Patent
Carrier, III

(10) Patent No.: US 6,481,146 B2
(45) Date of Patent: Nov. 19, 2002

(54) REAR SIGHT FOR A FIREARM

(76) Inventor: Clifford E. Carrier, III, 8201-A Argos St., Palms, CA (US) 92278

( * ) Notice: Subject to any disclaimer, the term of this patent is extended or adjusted under 35 U.S.C. 154(b) by 0 days.

(21) Appl. No.: 09/759,941

(22) Filed: Jan. 12, 2001

(65) Prior Publication Data

US 2002/0152663 A1 Oct. 24, 2002

Related U.S. Application Data

(60) Provisional application No. 60/176,053, filed on Jan. 14, 2000.

(51) Int. Cl.[7] ..... F41G 1/00; F41G 1/033
(52) U.S. Cl. ..... 42/136; 42/126; 42/111
(58) Field of Search ..... 42/136, 126, 111, 42/125, 135; 33/298

(56) References Cited

U.S. PATENT DOCUMENTS 846,638 A * 3/1907 Windridge ..... 42/136
1,200,152 A * 10/1916 Warner ..... 42/136
1,237,955 A * 8/1917 Price ..... 42/136
1,359,740 A * 11/1920 Prescott ..... 42/136
1,361,063 A * 12/1920 Joeck ..... 42/126
1,474,209 A * 11/1923 Reynolds ..... 42/126
2,005,866 A * 6/1935 Lowe ..... 42/137
2,165,796 A * 7/1939 Humeston ..... 42/126
4,575,961 A * 3/1986 Mikuta et al. ..... 42/136
5,363,559 A * 11/1994 McCarty ..... 33/298

* cited by examiner

*Primary Examiner*—Charles T. Jordan
*Assistant Examiner*—Lulit Semunegus
(74) *Attorney, Agent, or Firm*—Rothwell, Figg, Ernst & Manbeck PC

(57) ABSTRACT

A rear sight including a sight housing and a threaded sleeve. The sight housing has a threaded male portion for insertion into the threaded sleeve. The threaded sleeve is connected to the firearm though bushings which stabilize the threaded sleeve, yet allow it to rotate. Rotation of the threaded sleeve causes the sight housing to move up or down, depending on the direction of the rotation.

17 Claims, 8 Drawing Sheets

REAR SIGHT FOR A FIREARM

CROSS REFERENCE TO RELATED APPLICATION

This non-provisional application claims priority to U.S. Provisional Application Ser. No. 60/176,053, filed Jan. 14, 2000, the contents of which are incorporated herein by reference.

BACKGROUND OF THE INVENTION

1. Field of the Invention

The present invention relates to sights for use with firearms, and, more particularly, to a rear sight for use in an AR-15/M-16 type A2 style upper receiver/flat top A2 adapter, and variants thereof.

2. Discussion of the Background

Precious time and money are spent on meticulous ammunition preparation, and the pinnacle of firearms technology. Premium barrel, trigger, and reloading components are expertly assembled, then carefully tested for compatibility, fit, and consistency. Yet this firearm, and each round it delivers, is only equal to the sighting system it is aimed with. Every time the sight teeters between shots, or fails to track with an adjustment (backlash), it has undermined good sight alignment and ammunition preparation with mechanical sabotage.

Conventional rear sights suffer the disadvantage of being inconsistent. For example, conventional rear sights typically teeter between shots and/or fail to accurately track with an adjustment (backlash). While some conventional rear sights are available with a mechanism for adjusting the elevation of the sight, the adjustment mechanism provided in such conventional rear sights is, generally, inadequate to meet the precision, reliability, repeatability, and range of elevation required and, indeed, demanded by marksman and firearm professionals. Further, such conventional rear sights, typically, require extensive gunsmithing and modification to the firearm to ensure proper installation and use, even with these inherent drawbacks. An example of a conventional rear sight is shown in Appendix A and labeled "Outdated Technology"—"Wobbly Sights."

In the design of the conventional rear sight shown in Example A, the thumbwheel is directly mated with the sight housing—i.e., the thumbwheel is threaded and directly mated to the threaded portion of the sight housing. Direct mating designs are inherently flawed and result in the above-described problems with precision, reliability, repeatability, and range of elevation. There is a need for a rear sight design that overcomes the limited stability, precision, and range of elevation inherent in such conventional rear sight designs, that is capable of being installed and used without extensive gunsmithing.

SUMMARY OF THE INVENTION

Accordingly, one object of this invention is to provide a rear sight which does not teeter between shots and/or fail to accurately track with an adjustment (backlash).

It is another object of this invention to provide a rear sight apparatus for a firearm that meets the precision, reliability, repeatability, and range of elevation required by marksman and firearm professionals.

It is yet another object of the invention to provide a rear sight apparatus which is designed to be installed and used without extensive gunsmithing and modifications to the firearm with which the rear sight is being used.

These and other objects are achieved according to the present invention. The present invention provides a rear sight that overcomes the disadvantages and limitations of conventional rear sights. The rear sight apparatus of the present invention provides the precision, reliability, repeatability, and range of elevation required by marksman and firearm professionals every shot, each sight change, all yard lines, match after match. The rear sight of the present invention provides micrometer-like attributes and is designed to be installed and used without extensive gunsmithing.

In one embodiment, the rear sight of the present invention includes a sight housing and a threaded sleeve. The sight housing has a threaded male portion for insertion into the threaded sleeve. The threaded sleeve is connected to the firearm in such a way that it is able to rotate. Rotation of the threaded sleeve causes the sight housing to move up or down, depending on the direction of the rotation.

Preferably, the threaded sleeve is harbored between a top stationary bushing and a bottom stationary bushing, which offer increased multi-axis stability. These bushings are introduced within the firearms upper receiver component. They capture both ends of the threaded sleeve, allowing only calibrated rotation in the way of movement.

Advantageously, the rear sight also includes an elevation or thumb wheel for rotating the threaded sleeve. The thumb wheel encompasses the middle portion of the threaded sleeve and is slaved thereto with sufficient force to prevent slippage of the wheel. By slaving the thumb wheel to the threaded sleeve, the rotation of the thumb wheel causes the threaded sleeve to rotate.

Further features and advantages of the present invention, as well as the structure and operation of various embodiments of the present invention, are described in detail below with reference to the accompanying drawings.

BRIEF DESCRIPTION OF THE FIGURES

The accompanying drawing, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. Additionally, the left-most digit(s) of a reference number identifies the figure in which the reference number first appears.

DETAILED DESCRIPTION OF THE PREFERRED EMBODIMENTS

Figure 1:
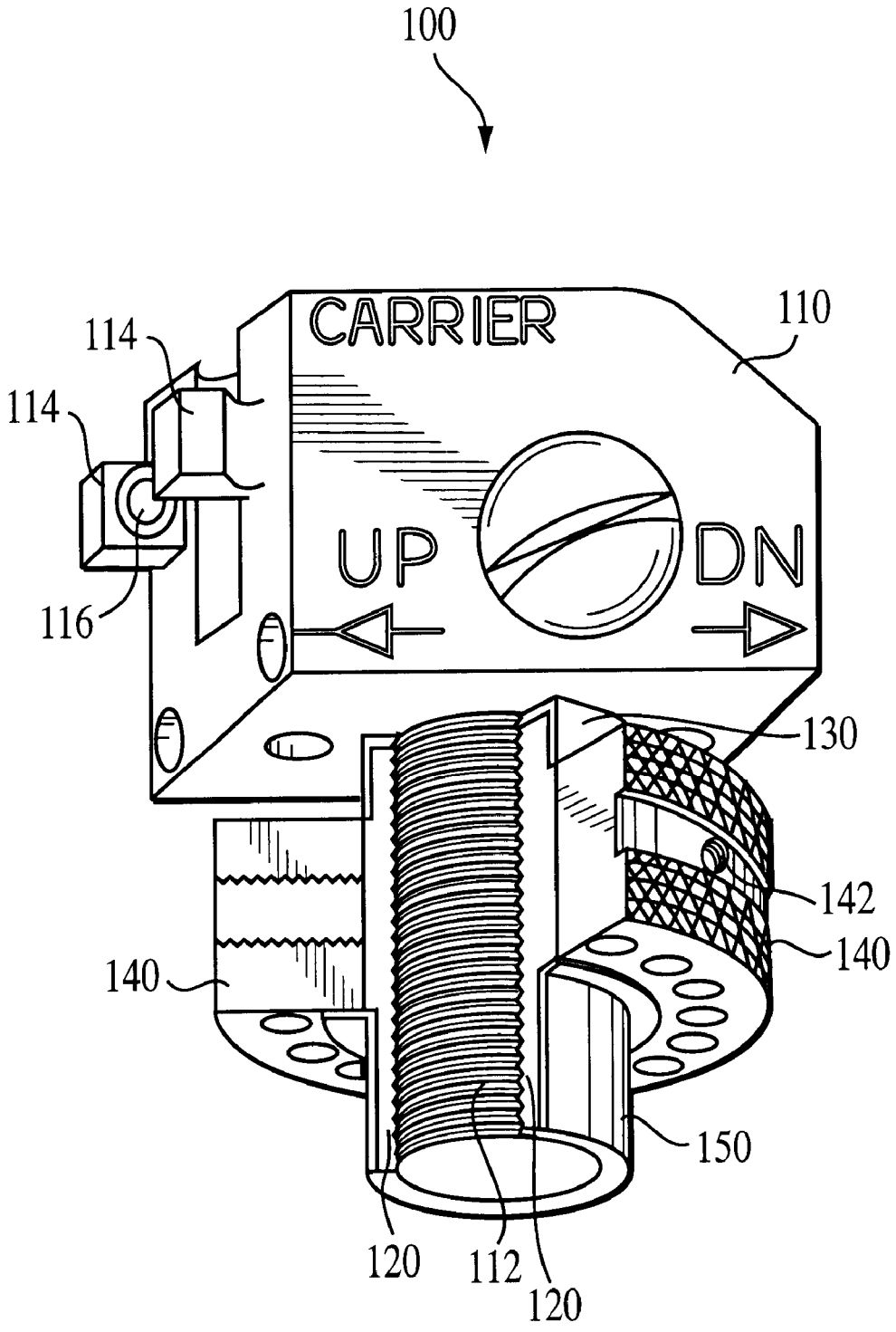
FIG. 1 shows a preferred embodiment of the rear sight according to the present invention.
Figure 2:
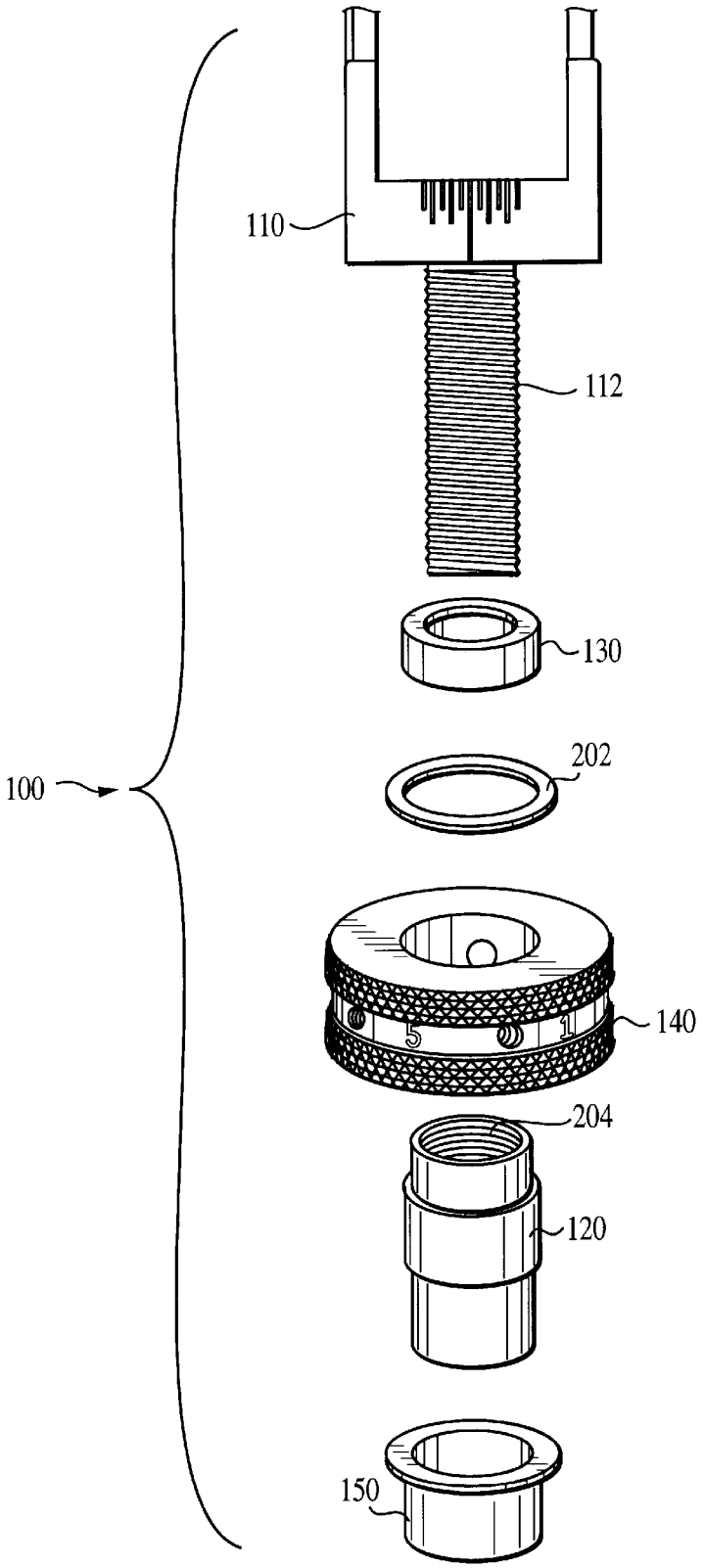
FIG. 2 is an exploded view of the rear sight.

FIG. 1 shows a rear sight 100 according to a preferred embodiment. FIG. 2 shows an exploded view of rear sight 100.

Rear sight 100 includes a sight housing 110 and a threaded sleeve 120. Sight housing 110 has a threaded male portion 112 that is inserted into threaded sleeve 120. In FIG. 1, rear sight 100 is shown cut away to better illustrate that a male portion 112 of sight housing 110 mates with threaded sleeve 120.

Figure 6:
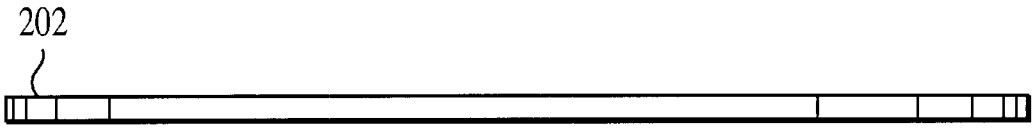
FIG. 6 further illustrates the shim.

Rear sight 100 also includes a press fit top bushing 130, which fits closely around the top portion of threaded sleeve 120. A bottom bushing 150, also press fit into upper receiver, fits closely around bottom portion of threaded sleeve 120. A thumb wheel 140 adapted to receive the threaded sleeve 130 through a central bore fits between top bushing 120 and bottom bushing 150. There is also provided a shim 202, as shown in FIG. 2, that enhances fitting and isolates top bushing 130 from being thrust upward during use. Shim 202 is further illustrated in FIG. 6.

Figure 7A:
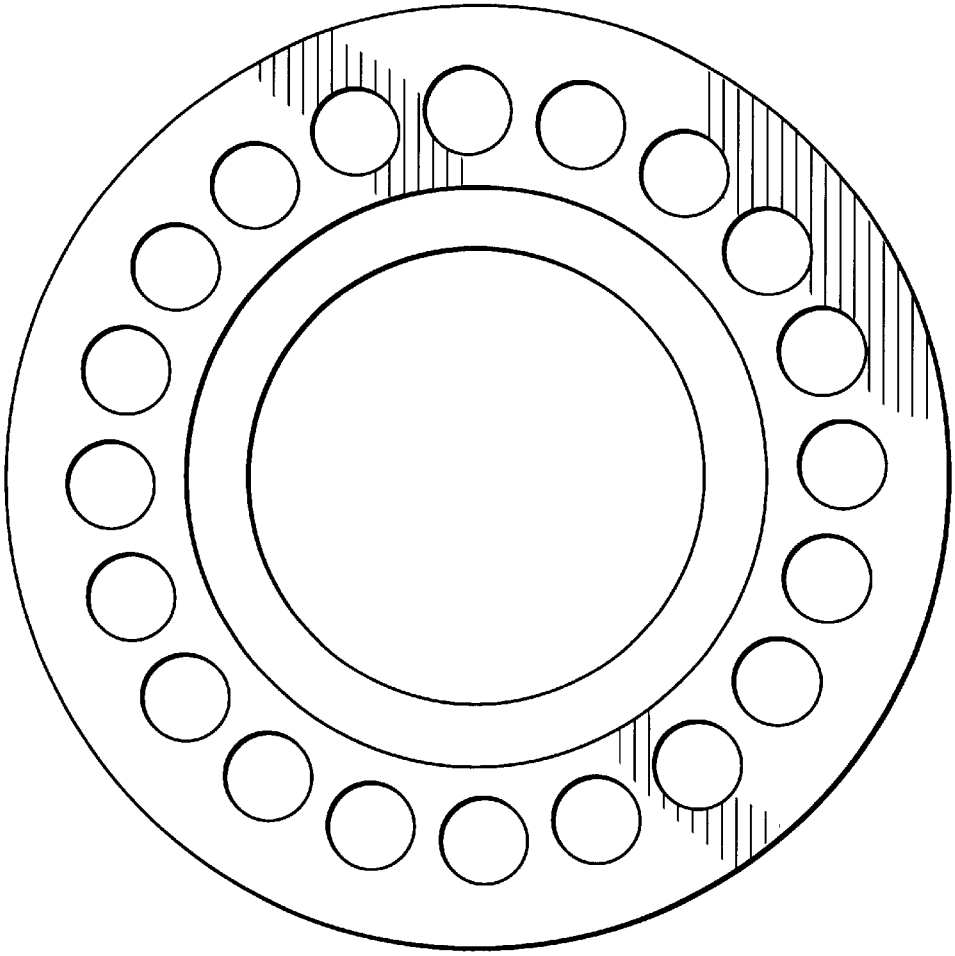
FIGS. 7A and 7B further illustrate the thumb wheel.
Figure 7B:
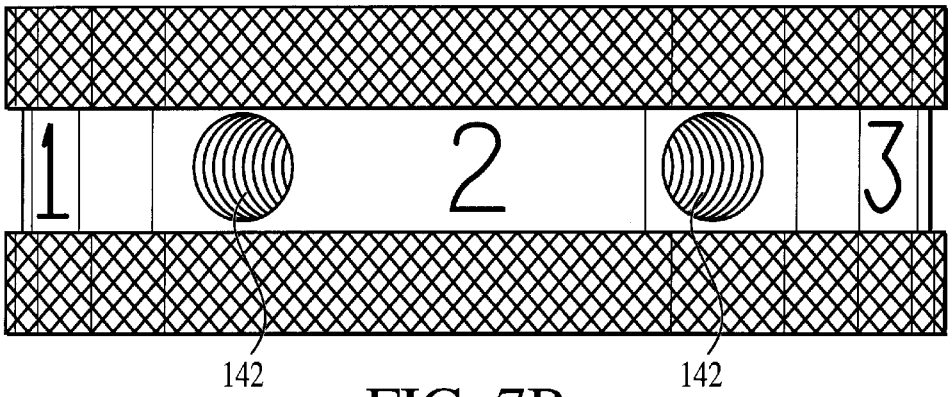

Thumb wheel 140 is secured to threaded sleeve 120 by set screws (not shown). A set screw hole 142 for receiving a set screw is shown in FIG. 1. The set screws provide extremely strong, 360° adjustable positioning. Preferably, the outer surface of thumb wheel 140 is provided with knurling to enhance traction and grip during turning. FIGS. 7A and 7B further illustrate thumb wheel 140. Because thumb wheel 140 is secured (i.e., slaved) to threaded sleeve 120, threaded sleeve 120 will rotate when thumb wheel 140 rotates.

Figure 9:
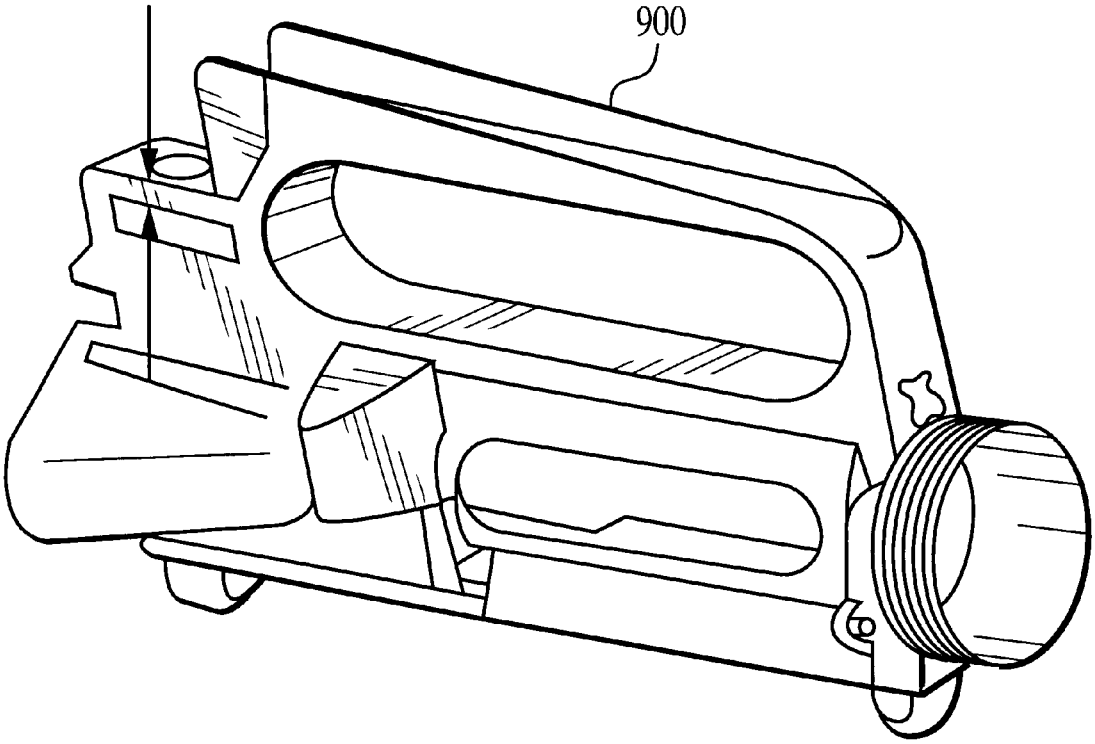
FIG. 9 illustrates an exemplary upper receiver.

When threaded sleeve 120 rotates, the threads 204 within threaded sleeve 120, which are in contact with threaded male portion 112, cause male portion 112 and sight housing 110 to move up or down, depending on the direction of the rotation. Preferably, threaded sleeve 120 and threaded male portion 112 are made from steel. Notice that the threads 204 and 112 in this system engage each other exclusively. This steel on steel arrangement preserves thread integrity, as well as preventing all abrasive thread contact with the upper receiver (FIG. 9).

Figure 3:
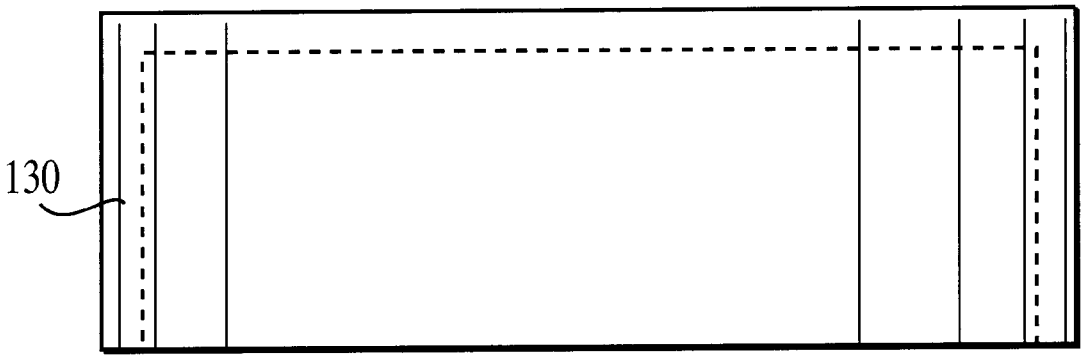
FIG. 3 further illustrates the top bushing.
Figure 5:
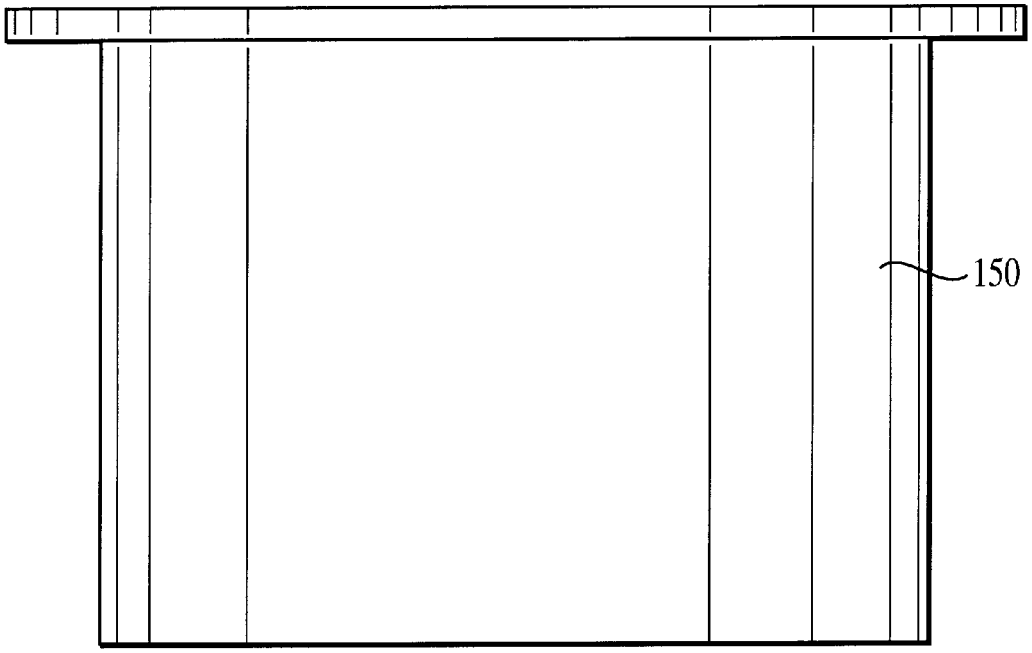
FIG. 5 further illustrates the bottom bushing.

Bushing 130, press fit into the upper receiver firmly captures threaded sleeve 120 and provides ultra close tolerances that prevent both vertical and rocking play of rear sight 100, yet still permits simple threading out of the housing for ease of cleaning. Top busing 130 includes an inward facing flange to facilitate positive seating upon sleeve 120. Top bushing 130 is further illustrated in FIG. 3. Preferably, press fit bottom bushing 150 is flanged for positive seating and protective shock absorption, should rear sight 100 ever be banged going into a safe, truck bed, "sling break dive", etc. Bottom bushing 150 is further illustrated in FIG. 5. The bushings 130 and 150 allow threaded sleeve 120 to rotate, but not to move otherwise, and thus provide rear sight 100 with a great amount of stability. That is, not only do bushings 130 and 150 function to stabilize threaded sleeve 120, but also thumb wheel 140 (i.e., only experiences rotational movement), by virtue of it being slaved to threaded sleeve 120, and sight housing 110, by virtue of threaded male portion 112 being precision mated with threaded sleeve 120. Bushings 130 and 150 are press fit within a firearm's upper receiver component. An exemplary upper receiver component 900 is illustrated in FIG. 9. A skilled gunsmith can easily install rear sight 100 into a conventional A2 upper receiver/flat top A2 adapter, or variants thereof.

Figure 4:
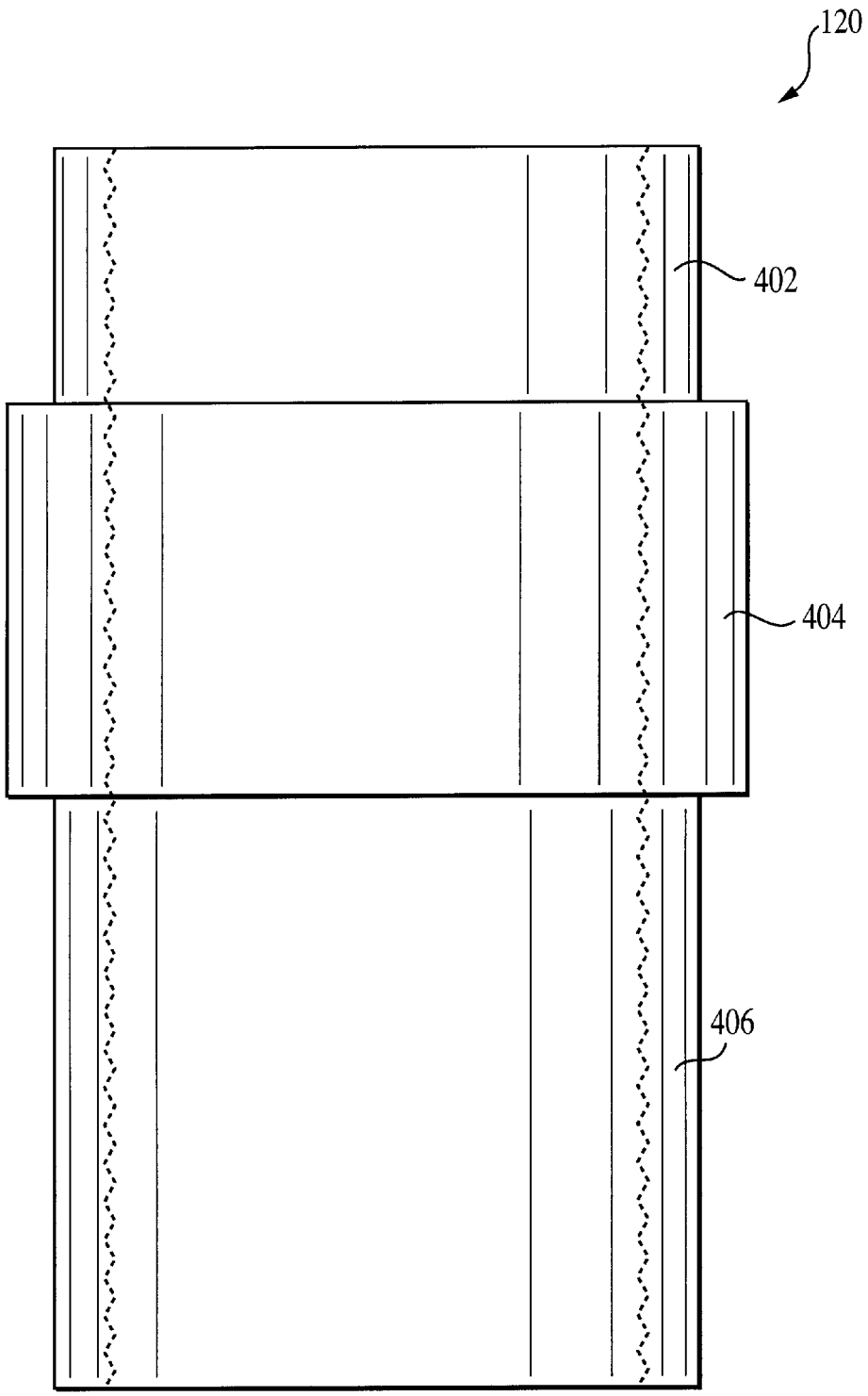
FIG. 4 further illustrates the threaded sleeve.

Referring to FIG. 4, threaded sleeve 120 includes a top section 402, a middle section 404 and a bottom section 406. As described above, top bushing 130 fits around top portion 402, thumb wheel 140 is secured to middle section 404 by set screws, and bottom bushing 150 fits around bottom portion 406. The threads 204 within threaded sleeve 120 are preferably precision threads that provide one quarter minute per click bullet shifts. Advantageously, threaded sleeve 120 is heat treated and finished to give it micrometer like feel while it rotates within its complementary cradle formed by the dual bushings 130 and 150.

Figure 8A:
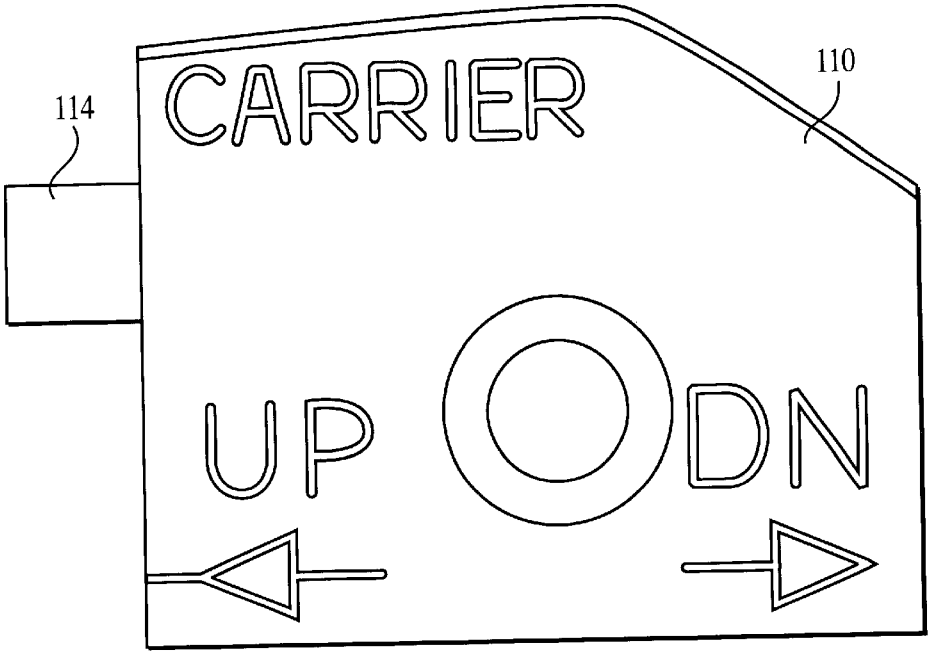
FIGS. 8A and 8B further illustrate the sight housing.
Figure 8B:
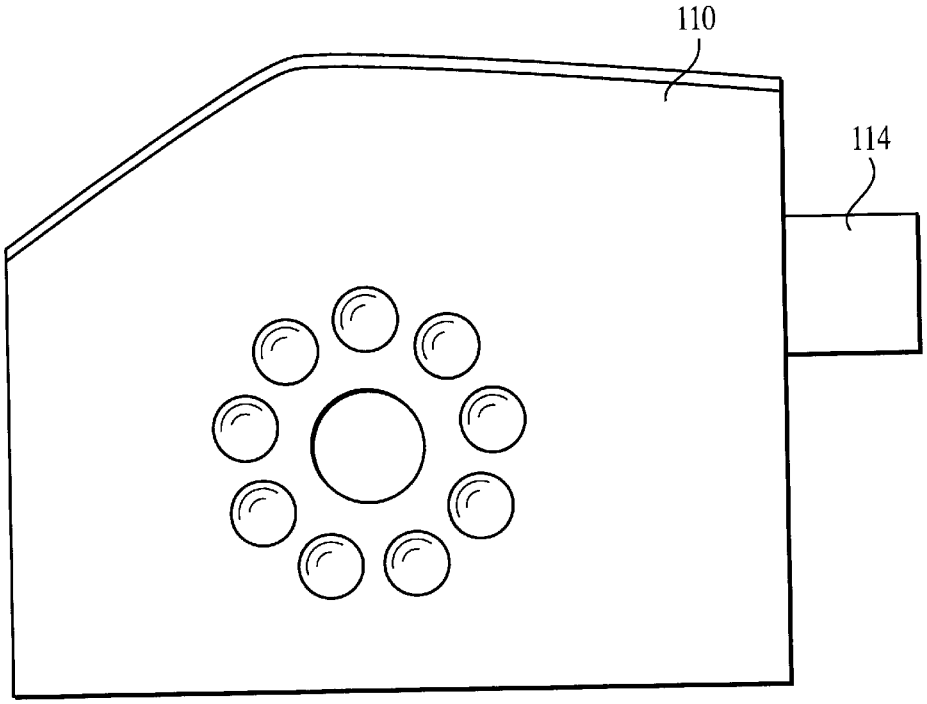

Referring to FIG. 1 and FIGS. 8A and 8B, sight housing 110 is further illustrated. Sight housing 110 includes forward extensions 114, which provide enhanced range of elevation and stabilization superior to "pinning" methods. Forward extensions 114 allow zeros from 100 to 1,000 yards with no need to adjust a front sight somewhere in between. Set screw(s) 116 are provided to eliminate sight housing 110 rotation throughout seventy minutes of elevation travel, by bearing equal pressure on opposing inner walls (not shown) of a carrying handle groove (not shown).

While a preferred embodiment of the present invention has been described above, it should be understood that it has been presented by way of example only, and not limitation. Thus, the breadth and scope of the present invention should not be limited by the above described exemplary embodiment.

A color brochure, and a copy thereof, are attached hereto as Appendix A. The brochure further illustrates rear sight 100 and upper receiver 900.

What is claimed is:

1. A sight, comprising:

a threaded sleeve having a top section, a middle section, and a bottom section;

a sight housing having a threaded male portion for mating with said threaded sleeve;

first and second stationary bushings for stabilizing said threaded sleeve, said first bushing fitting around said top section of said threaded sleeve, said second bushing fitting around said bottom section of said threaded sleeve, and said bushings allowing rotational movement of said threaded sleeve, wherein when said male portion is mated with said threaded sleeve and said threaded sleeve rotates, said housing moves either up or down depending on the direction of rotation of said threaded sleeve.

2. The sight of claim 1, further comprising a thumb wheel secured to said middle section of said threaded sleeve.

3. The sight of claim 1, wherein said first stationary bushing includes an inward facing flange for positive press fit seating within an upper receiver.

4. The sight of claim 1, wherein said second stationary bushing includes an outward facing flange for positive press fit seating within an upper receiver.

5. The sight of claim 1, wherein said threaded sleeve is heat treated.

6. The sight of claim 1, wherein said sight housing includes first and second forward extensions for enhancing the range of elevation and for stabilizing the sight housing.

7. An apparatus for adjusting the elevation of a sight for a firearm, comprising:

a sight housing having a threaded male portion;

an elevation wheel having a central bore adapted to receive the threaded male portion of said sight housing; and a threaded sleeve having an inner surface and an outer surface, wherein said inner surface is threaded for engagement with the threaded male portion of said sight housing and said outer surface is received in the central bore of said elevation wheel, said threaded sleeve and said elevation wheel being fixedly engaged to rotate in unison for moving said sight housing up or down depending on the direction of rotation.

8. The apparatus of claim 7, wherein said threaded sleeve includes a top section, a middle section, and a bottom section, and wherein said elevation wheel engages said threaded sleeve in said middle section, and wherein the sight further comprises first and second bushings, said first bushing mounted on the outer surface of said threaded sleeve in said top section and said second bushing mounted on the outer surface of said threaded sleeve in said bottom section.

9. The apparatus of claim 8, wherein said first bushing includes an inward facing flange for positive press fit seating within an upper receiver.

10. The apparatus of claim 8, wherein said second bushing includes an outward facing flange for positive press fit seating within an upper receiver.

11. The apparatus of claim 7, wherein said threaded sleeve is heat treated.

12. The apparatus of claim 7, wherein said sight housing includes first and second forward extensions for enhancing the range of elevation and for stabilizing the sight housing.

13. In a sight used for aiming including a sight housing having a threaded male portion and an elevation wheel having a central bore adapted to receive the male portion of the sight housing, wherein the improvement comprises:

a threaded sleeve having an inner surface and an outer surface, wherein said inner surface is threaded for engagement with the threaded male portion of said sight housing and said outer surface is received in the central bore of said elevation wheel, said threaded sleeve and said elevation wheel being fixedly engaged to rotate in unison for moving said sight housing up or down depending on the direction of rotation.

14. The sight of claim 13, wherein said threaded sleeve includes a top section, a middle section, and a bottom section, and wherein said elevation wheel engages said threaded sleeve in said middle section, and wherein the sight further comprises first and second bushings, said first bushing mounted on the outer surface of said threaded sleeve in said top section and said second bushing mounted on the outer surface of said threaded sleeve in said bottom section.

15. The sight of claim 14, wherein said first bushing includes an inward facing flange for positive press fit seating within an upper receiver.

16. The sight of claim 14, wherein said second bushing includes an outward facing flange for positive press fit seating within an upper receiver.

17. The sight of claim 14, wherein said threaded sleeve is heat treated.

* * * * *